United States Patent [19]

Sutherland

[11] 4,456,802

[45] Jun. 26, 1984

[54] ANTI-RATTLE PUSHBUTTON ASSEMBLY

[75] Inventor: Donald M. Sutherland, Ann Arbor, Mich.

[73] Assignee: Ford Motor Company, Dearborn, Mich.

[21] Appl. No.: 484,120

[22] Filed: Apr. 11, 1983

[51] Int. Cl.[3] ..... H01H 3/12

[52] U.S. Cl. ..... 200/340; 200/5 A; 334/7

[58] Field of Search ..... 200/340, 5 A, 5 D, 5 E, 200/DIG. 25; 74/10 R, 10.1; 400/472, 490, 491.2; 334/7, 54

[56] References Cited

U.S. PATENT DOCUMENTS

| | | | |
|---|---|---|---|
| 3,309,487 | 3/1967 | Fisher | 200/340 |
| 3,412,619 | 11/1968 | Pelletier | 74/10.33 |
| 3,673,531 | 6/1972 | Zane | 200/5 E X |
| 3,964,000 | 6/1976 | Schijven | 334/7 |
| 4,056,700 | 11/1977 | Stannek | 200/5 A X |
| 4,143,252 | 3/1979 | Moore | 200/5 E X |

FOREIGN PATENT DOCUMENTS

| | | | |
|---|---|---|---|
| 945041 | 6/1956 | Fed. Rep. of Germany | 334/7 |
| 2154450 | 5/1973 | Fed. Rep. of Germany | 74/10.1 |

*Primary Examiner*—John W. Shepperd
*Assistant Examiner*—Renee S. Kiderf
*Attorney, Agent, or Firm*—Paul K. Godwin, Jr.; Robert D. Sanborn

[57] ABSTRACT

End caps of a pushbutton assembly are formed to include biased tabs with raised portions extending towards adjacent pushbutton end caps so that when the pushbuttons of the assembly are in their unactuated position along a common reference plane, lateral compression exists between the pushbuttons so that rattle noise is eliminated.

21 Claims, 2 Drawing Figures

ANTI-RATTLE PUSHBUTTON ASSEMBLY

BACKGROUND OF THE INVENTION

1. Field of the Invention

The present invention is directed to the field of pushbutton assemblies and more specifically to the area of radio tuners which employ mechanical pushbutton assemblies.

2. Description of the Prior Art

Conventional pushbutton devices for mechanically tuned radio receivers, such as shown in U.S. Pat. No. 3,964,000 and incorporated herein by reference, include spring return pushbutton mechanisms that are slideably mounted in a chassis so that the various pushbuttons are linearly disposed alongside each other. Since most radio tuners of this type, are employed in automotive applications, they are subject to vibration which, in many cases, causes the components to rattle about and create a noise which is perceived as an annoyance to the user. Conventionally, noise reduction is achieved by providing thin sheets of foam rubber or other cellular material along the inner front surface of the chassis in a manner so as to allow the pushbutton slider elements to penetrate therethrough. The function of the cellular material is merely to damp the vibrations of the sliders and reduce the noise. However, the fact that such cellular material is provided as an additional element to the radio tuner and must be cut to the proper size and properly installed adds a cost factor to the tuner.

SUMMARY OF THE INVENTION

The present invention is intended to eliminate noise due to rattling of adjacent pushbutton elements, within a mechanically tuned radio receiver, by providing integral elements within the pushbutton construction which prevent rattling. The present invention provides a modification to conventional pushbutton caps mounted on corresponding slider elements, whereby the plastic caps are formed to include cantilevered tabs having raised portions which abut adjacent pushbuttons when the pushbuttons are in the unactuated position. In this position, the cantilevered tabs provide lateral compression forces to adjacent pushbuttons and thereby eliminate rattle noise normally attributed to applied vibrations.

DETAILED DESCRIPTION OF THE PREFERRED EMBODIMENT

Figure 1:
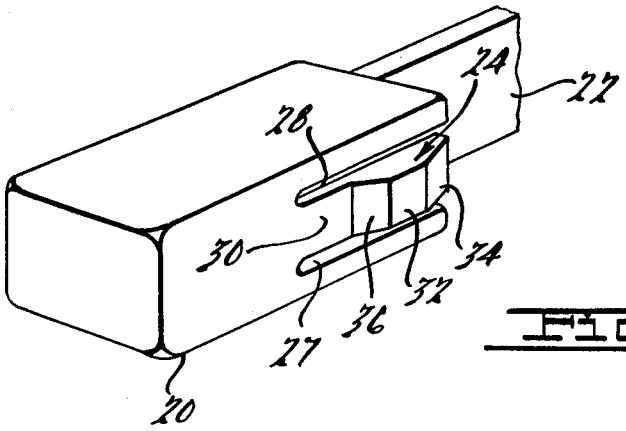
FIG. 1 is a perspective view of an individual pushbutton end cap incorporating the present invention.

In FIG. 1, an elongated slider element 22 is shown having a manually depressible end cap 20 attached thereto. The end cap 20 is generally wide enough to allow depression by an operator's finger to a predetermined depth. The end cap 20 is preferably made of a molded plastic material and is formed with an integral tab section 24 defined by grooves 27 and 28 on either side thereof. An arm portion 30 of the cantilevered tab 24 is connected to the main body of the pushbutton end cap 20 and provides resistance to compression forces applied to the tab. The tab further includes a forward ramp surface 34, a contacting compression surface 32 and a rearward ramp surface 36.

Figure 2:
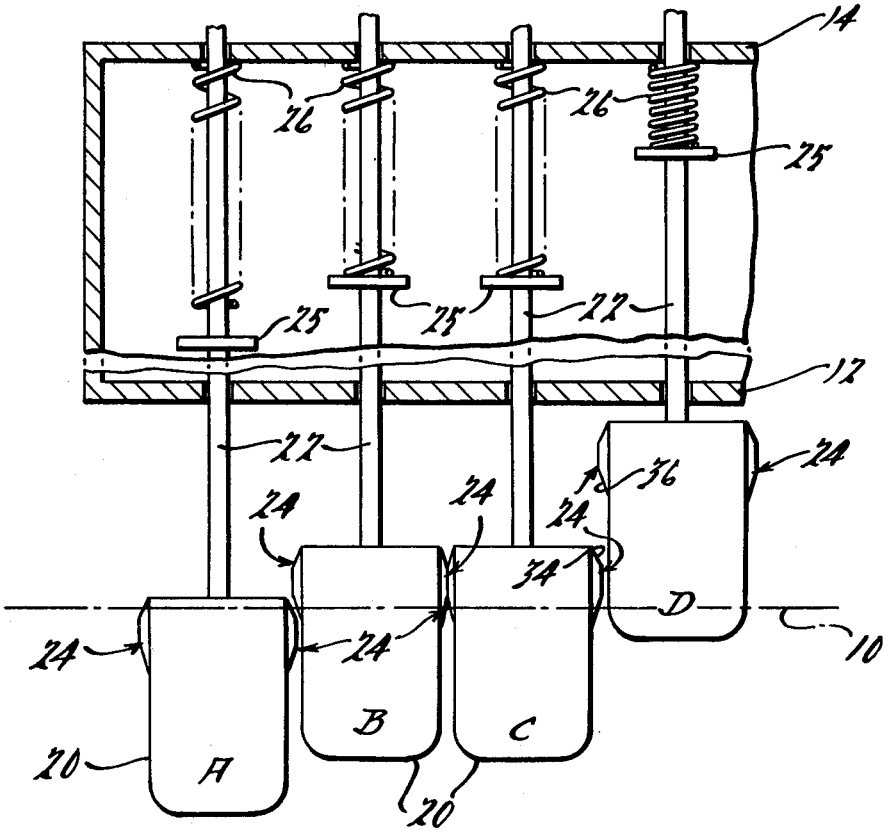
FIG. 2 is a partial cross-sectional view of a typical pushbutton assembly incorporating the present invention.

While only a single cantilevered tab 24 is shown on the pushbutton end cap 20 in FIG. 1, there are instances where it may be preferable to include tabs on opposite sides of the pushbutton end cap, as shown in FIG. 2.

The pushbutton assembly shown in FIG. 2 is intended to be illustrative of the functional aspects of the present invention whereby lateral compression forces are applied to adjacent pushbuttons when in their unactuated positions to prevent noise from occurring due to externally applied vibration.

In FIG. 2, a datum line 10 indicates a reference plane to which the unactuated pusbbuttons are returned upon the relief of depression forces. In a physical installation, the face plate of the radio tuner would normally surround the pushbuttons at that reference plane. A plurality of pushbuttons 20 of identical construction are shown in a side-by-side arrangement and are designated as "A", "B", "C" and "D".

A cross-section of a chassis is shown having a front slider support element 12 and a rear slider support element 14 to allow longitudinal movement of the slider elements 22 of each of the pushbuttons when forces are applied to the end cap 20. Each of the slider elements is shown as configured with a return spring 16 that abuts against a stop 25 on the slider element 22 in order to return the pushbuttons to their normal unactuated positions, as represented by pushbuttons "B" and "C", upon release of depression forces, such as are applied to pushbutton "D".

In most radio receiver tuners, pushbuttons may be pulled out to a memory reset position, such as shown with respect to pushbutton "A", so that the receiver can be manually tuned to a station that will thereafter be mechanically tuned by depression of pushbutton "A". Therefore, in the FIG. 2 embodiment, the pushbuttons may assume a plurality of positions with respect to the reference plane 10 but in normal operation will assume the unactuated positions indicated by pushbuttons "B" and "C".

In the FIG. 2 embodiment, the pushbuttons have cantilevered tabs 24 formed on opposite sides so that, in the unactuated positions, surfaces 32 of adjacent pushbuttons will be abutting and providing lateral compression forces to stabilize the assembly. When it is desired to depress a pushbutton such as "D" from its unactuated position, there is little resistance to depression forces contributed by the tabs 24, since the surfaces 32 are smooth and readily slide over each other. When the depression forces are relieved, the spring 26 restores the pushbutton back to its unactuated position by providing sufficient restoration force to slide the ram surfaces of adjacent pushbutton tabs over each other.

Similarly, when it is desirable to reset the pushbutton memory by pulling pushbutton "A" outward, the surfaces 32 slide over each other and offer little resistance to the longitudinally applied pulling forces. When the pushbutton "A" is depressed to assume a new memory position, the tabs of adjacent pushbuttons again slide over each other on the ramp surfaces and the pushbutton "A" is fully depressed to the "D" position and released.

It will be readily apparent that many modifications and variations may be implemented without departing from the scope of the novel concept of this invention. Therefore, it is intended by the appended claims to cover all such modifications and variations which fall within the true spirit and scope of the invention.

I claim:

1. A pushbutton assembly with a plurality of depressible pushbuttons contiguously disposed for manual actuation, wherein each pushbutton contains a manual contacting end cap formed of sufficient dimensions to be depressible a predetermined distance by an operator's finger and wherein each contacting end cap contains means biased for contacting the next adjacent end cap of the next adjacent pushbutton and prevent rattle noise from occurring.

2. An assembly as in claim 1, wherein the contacting means of each end cap contains at least one cantilevered tab having a raised portion on said tab for extending towards and contacting the next adjacent end cap when said pushbuttons are in their unactuated positions.

3. A pushbutton assembly as in claim 2, wherein said cantilevered tabs are integrally formed with said end caps.

4. An assembly as in claim 1, wherein said contacting means includes a cantilevered tab having a raised portion on said tab for extending towards and contacting a like raised portion on the next adjacent end cap when said pushbuttons are in their unactuated positions.

5. A pushbutton assembly as in claim 4, wherein said cantilevered tabs are integrally formed with said end caps.

6. An assembly as in claim 1, wherein each end cap contains a cantilevered tab having a raised portion on said tab for extending towards and contacting a like raised portion of a cantilevered tab on the next adjacent end cap when said pushbuttons are in their unactuated positions.

7. A pushbutton assembly as in claim 6, wherein said cantilevered tabs are integrally formed with said end caps.

8. A pushbutton assembly as in claim 1, wherein said assembly is installed in a mechanical radio tuner, the pushbuttons assume unactuated positions along a common reference plane and are each actuatable to a position in a direction normal to said reference plane and said biasing means abuts the next adjacent end cap when both adjacent end caps are in their unactuated positions.

9. An assembly as in claim 8, wherein the contacting means of each end cap contains at least one cantilevered tab having a raised portion on said tab for extending towards and contacting the next adjacent end cap when said pushbuttons are in their unactuated positions.

10. A pushbutton assembly as in claim 9, wherein said cantilevered tabs are integrally formed with said end caps.

11. An assembly as in claim 8, wherein said contacting means includes a cantilevered tab having a raised portion on said tab for extending towards and contacting a like raised portion on the next adjacent end cap when said pushbuttons are in their unactuated positions.

12. A pushbutton assembly as in claim 11, wherein said cantilevered tabs are integrally formed with said end caps.

13. An assembly as in claim 8, wherein each end cap contains a cantilevered tab having a raised portion on said tab for extending towards and contacting a like raised portion on a cantilevered tab on the next adjacent end cap when said pushbuttons are in their unactuated positions.

14. A pushbutton assembly as in claim 13, wherein said cantilevered tabs are integrally formed with said end caps.

15. A mechanical pushbutton assembly wherein a plurality of pushbuttons are contiguously disposed, comprising:

a slideable element extending from each pushbutton;

means for mounting said slideable elements to allow longitudinal movement of each slideable element when its corresponding pushbutton is depressed;

means for restoring each pushbutton and its slideable element to an unactuated position when depression forces are removed from said pushbutton; and means on said pushbuttons for providing lateral compression forces between adjacent pushbuttons when said pushbuttons are in the unactuated position.

16. An assembly as in claim 15, wherein the lateral compression means includes at least one cantilevered tab on each pushbutton having a raised portion on said tab for extending towards and contacting the next adjacent pushbutton when said adjacent pushbuttons are in the unactuated position.

17. As assembly as in claim 16, wherein said cantilevered tabs are integrally formed with said pushbuttons.

18. An assembly as in claim 15, wherein each pushbutton contains a cantilevered tab having a raised portion on said tab for extending towards and contacting a like raised portion on the next adjacent pushbutton when said adjacent pushbuttons are in their unactuated positions.

19. An assembly as in claim 18, wherein said cantilevered tabs are integrally formed with said pushbuttons.

20. An assembly as in claim 15, wherein each pushbutton contains a cantilevered tab having a raised portion on said tab for extending towards and contacting a like raised portion of the cantilevered tab on the next adjacent pushbutton when said adjacent pushbuttons are in their unactuated positions.

21. An assembly as in claim 20, wherein said cantilevered tabs are integrally formed with said pushbuttons.

* * * * *